US008182402B2

(12) United States Patent
Prstojevich et al.

(10) Patent No.: US 8,182,402 B2
(45) **Date of Patent: *May 22, 2012**

(54) REACTION TRAINING BELT WITH VARIABLE RELEASE RESISTANCE

(75) Inventors: Mike Prstojevich, Portland, OR (US); William Dieter, Portland, OR (US); James Thorne, Portland, OR (US); Bora Erdos, Los Angeles, CA (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/948,618

(22) Filed: Nov. 17, 2010

(65) Prior Publication Data

US 2011/0111931 A1 May 12, 2011

Related U.S. Application Data

(63) Continuation of application No. 12/176,715, filed on Jul. 21, 2008, now Pat. No. 7,854,692.

(60) Provisional application No. 60/951,190, filed on Jul. 20, 2007.

(51) Int. Cl.
*A63B 21/002* (2006.01)
*A63B 67/00* (2006.01)

(52) U.S. Cl. ..... 482/91; 273/451

(58) Field of Classification Search ..... 482/121, 482/129, 124, 139, 91, 81–82; 273/452, 273/440, 451; 434/234; 24/303
See application file for complete search history.

(56) References Cited

U.S. PATENT DOCUMENTS

| | | | | |
|---|---|---|---|---|
| 4,026,548 | A * | 5/1977 | Birdwell | 482/129 |
| 4,153,245 | A * | 5/1979 | McCoy | 273/451 |
| 4,346,884 | A * | 8/1982 | Warehime | 273/451 |
| 4,572,511 | A * | 2/1986 | Barringer | 273/451 |
| 4,651,989 | A | 3/1987 | Wilson | |
| 5,002,273 | A * | 3/1991 | Sela | 473/450 |
| 5,713,307 | A * | 2/1998 | Polston et al. | 119/708 |
| 5,746,672 | A * | 5/1998 | Smith | 473/464 |
| 5,951,443 | A | 9/1999 | Askins | |
| 6,601,539 | B1 * | 8/2003 | Snook | 119/710 |
| 6,857,169 | B2 * | 2/2005 | Chung | 24/303 |
| 7,234,208 | B2 * | 6/2007 | Harley | 24/303 |
| 7,308,737 | B2 * | 12/2007 | Saitoh et al. | 24/303 |
| 7,384,382 | B2 * | 6/2008 | Farrah et al. | 482/124 |

(Continued)

OTHER PUBLICATIONS

International Search Report; PCT Appln. No. PCT/US08/070631; Jul. 21, 2008; 2 pages.

(Continued)

*Primary Examiner* — Fenn Mathew
(74) *Attorney, Agent, or Firm* — Banner & Witcoff, Ltd.

(57) ABSTRACT

A cost effective training belt that offers the ability to vary the release resistance and that allows the release resistance to remain relatively constant throughout the life of the belt. In one disclosed embodiment, the reaction belt has a first and second belt detachably secured together with a detaching structure that can connect the first and second belts together in at least two different ways. Each of the connecting ways offers a different release resistance; thereby a user can select the desired release resistance by selecting which way to connect the two belts together.

20 Claims, 3 Drawing Sheets

U.S. PATENT DOCUMENTS

| | | | | |
|---|---|---|---|---|
| 7,438,669 | B1 * | 10/2008 | Bloom | 482/49 |
| 7,854,692 | B2 * | 12/2010 | Prstojevich et al. | 482/91 |
| 2005/0192169 | A1 * | 9/2005 | Girgen et al. | 482/139 |
| 2006/0174455 | A1 * | 8/2006 | Saitoh et al. | 24/303 |
| 2007/0199182 | A1 * | 8/2007 | Johnson | 24/265 BC |
| 2009/0000565 | A1 * | 1/2009 | Bryce | 119/707 |

OTHER PUBLICATIONS

Written Opinion of the International Searching Authority; PCT Appln. No. PCT/US08/070631; Jul. 21, 2008; 4 pages.
Notification of Transmittal of the International Search Report; PCT Appln. No. PCT/US08/070631; Jul. 21, 2008; 1 page.

* cited by examiner

REACTION TRAINING BELT WITH VARIABLE RELEASE RESISTANCE

CROSS-REFERENCE TO RELATED APPLICATION

This application is a continuation of U.S. patent application Ser. No. 12/176,715 filed Jul. 21, 2008 entitled "Reaction Training Belt With Variable Release Resistance" which application claims priority to U.S. provisional patent application Ser. No. 60/951,190, filed on Jul. 20, 2007. These parent applications are entirely incorporated herein by reference and made a part hereof.

FIELD OF THE INVENTION

The present invention related to a reaction belt, which is also commonly known as a shadow belt, that detachably tethers one athlete to another usually for training purposes.

BACKGROUND OF THE INVENTION

Reaction training belts, which are also known as shadow belts, are commonly used by athletes to develop and improve their agility, reaction time and quickness. In general, a reaction belt detachably tethers one athlete to another. During use, one of the athletes attempts to move away from the other athlete so as to detach the tether between them. The other athlete attempts to move with the first athlete so as to prevent the tether from becoming detached. The second athlete attempts to keep the tether attached to the other athlete as long as possible.

Athletes can perform a variety of pursuit and reaction drills that add another dimension to training Ideally, athletes are matched evenly for speed, quickness and agility so that it provides a greater challenge and forces the drill to last longer. The drill can match sport specific positions against each other and can be focused on an area similar to the distance each position runs or moves in a game.

Known reaction belts are usually detachably secured with a detaching structure that do not allow for the release resistance to be adjusted. For example, know reaction belts attach via hook and loop material and the like.

Moreover, these known attachment structures tend to deteriorate over time, thereby compromising their durability.

SUMMARY OF THE INVENTION

Accordingly, despite the known reaction belts, there remains a need for a cost effective training belt that offers the ability to vary the release resistance and that allows the release resistance to remain relatively constant throughout the life of the belt. These and other improvement is found in the present invention.

In one disclosed embodiment, the reaction belt has a first and second belt detachably secured together with a detaching structure that can connect the first and second belts together in at least two different ways. Each of the connecting ways offers a different release resistance; thereby a user can select the desired release resistance by selecting which way to connect the two belts together.

DETAILED DESCRIPTION OF PREFERRED EMBODIMENTS

A reaction training belt system 10 having a first belt 10*a* detachably secured to a second belt 10*b* by a detaching structure 12 that allows the release resistance to be adjusted is shown in FIGS. 1-30.

Figure 1:
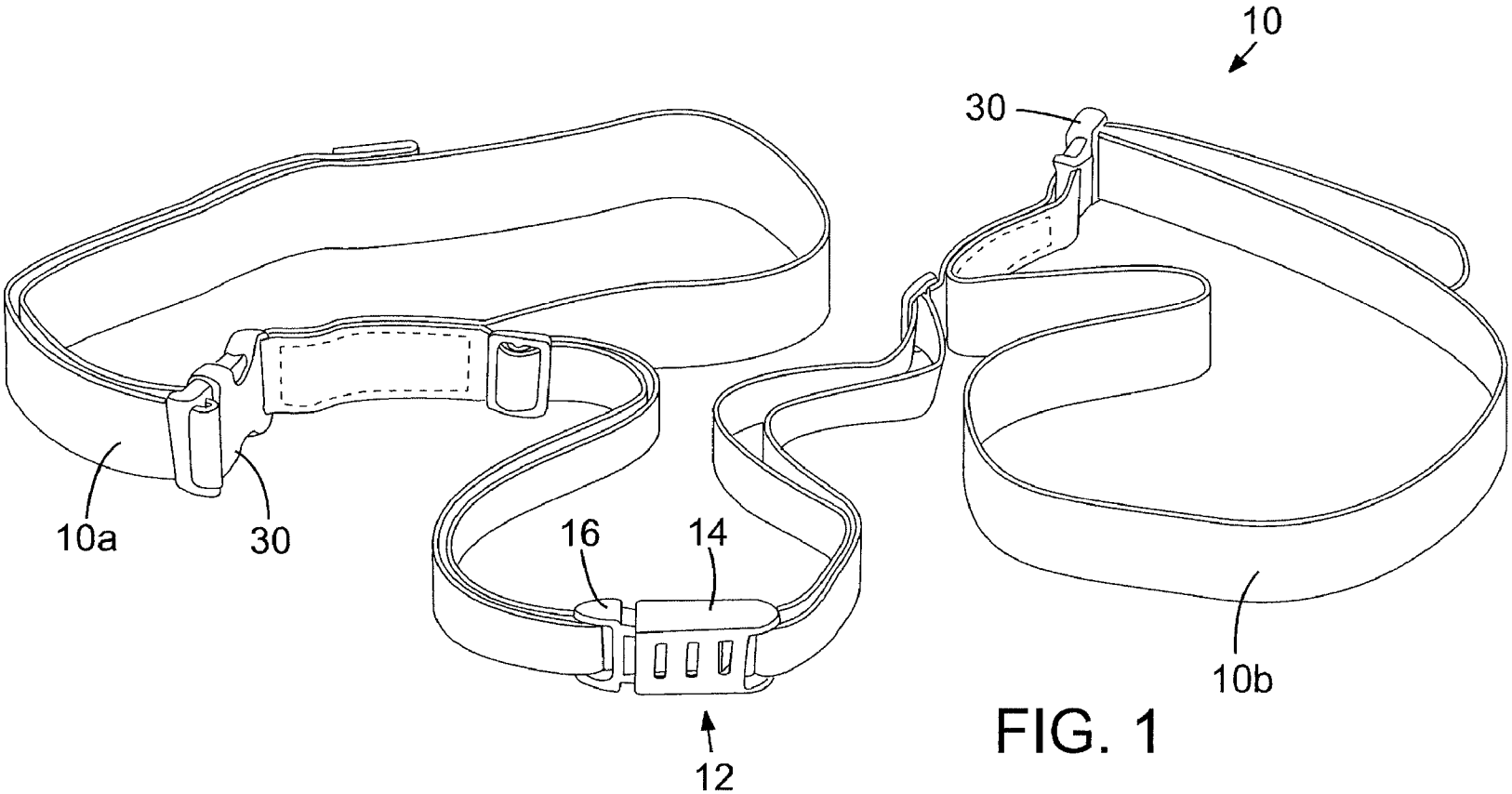
FIG. 1 is an isometric view of a reaction training belt system having two portions that are detachably secured together with a detaching structure that offers the release resistance to be adjusted in accordance with an embodiment of the present invention.
Figure 2:
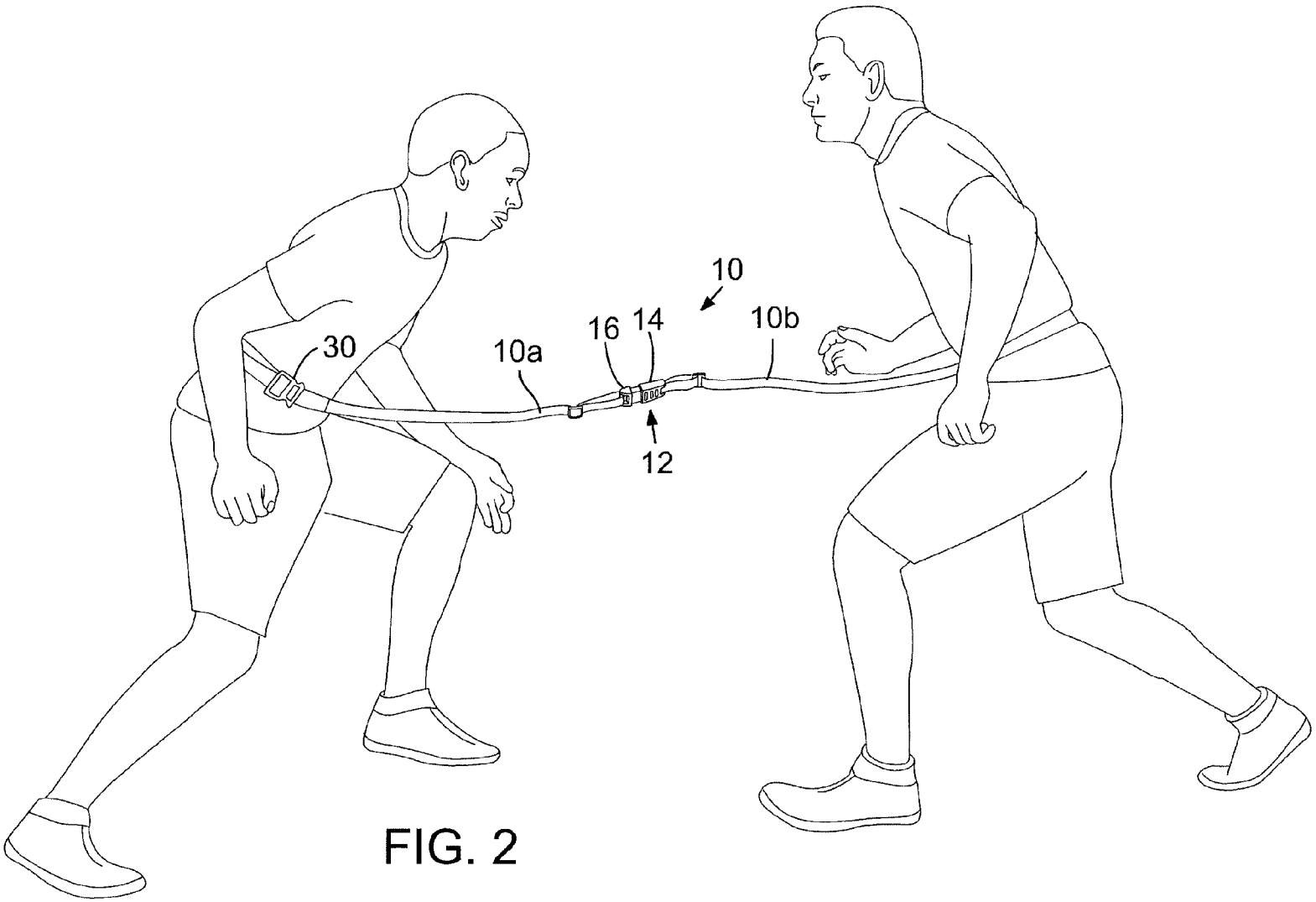
FIG. 2 is the reaction training belt system of FIG. 1 showing a possible use by two athletes.

The first and second belts 10*a*, 10*b* are formed of a flexible material, and they are preferably adjustable so as to be operably secured around an athlete as best shown in FIG. 2. Preferably, the distal ends of each belt 10*a*, 10*b* are joined to the detaching structure 12.

One possible detaching structure 12 is shown in FIGS. 1-30. Preferably, the detaching structure 12 has a male portion 16 operably received within a female portion 14. Protrusions 15 extending from the sides of the male portion operably engage one pair of a plurality of openings 18*a-c*, aligned on the female portion as shown. Each pair of openings 18*a-c* is preferably sized so as to offer a different degree of release resistance at which the protrusions 15 will detach from the opening 18*a-c* when the two belts 10*a*-10*b* are urged in different directions from each other.

Figure 3A:
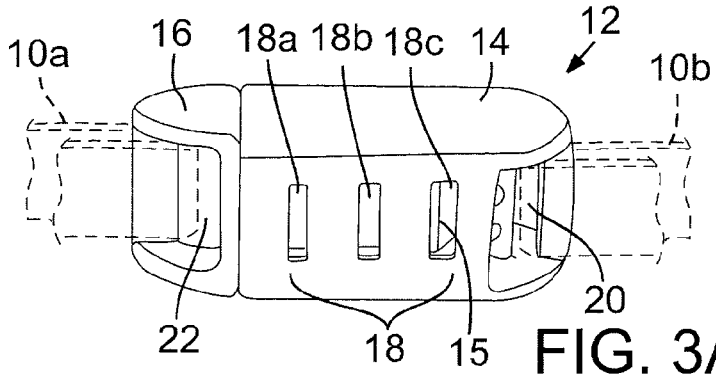
FIG. 3A is an enlarged view of the detaching structure of FIG. 1 showing a first possible engagement position offering a first possible release resistance.
Figure 3B:
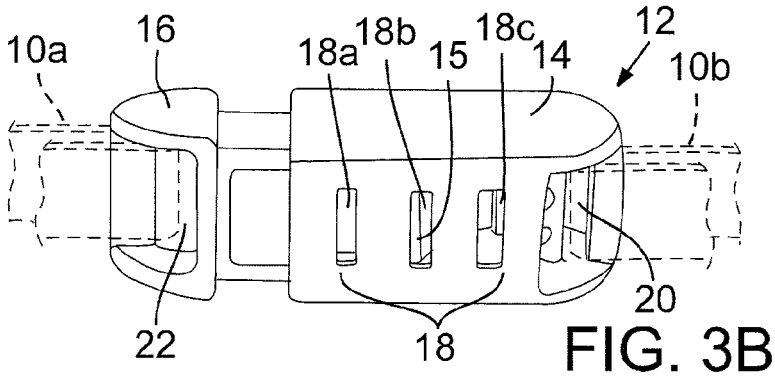
FIG. 3B is an enlarged view of the detaching structure of FIG. 3A showing a second possible engagement position offering a second possible release resistance.
Figure 3C:
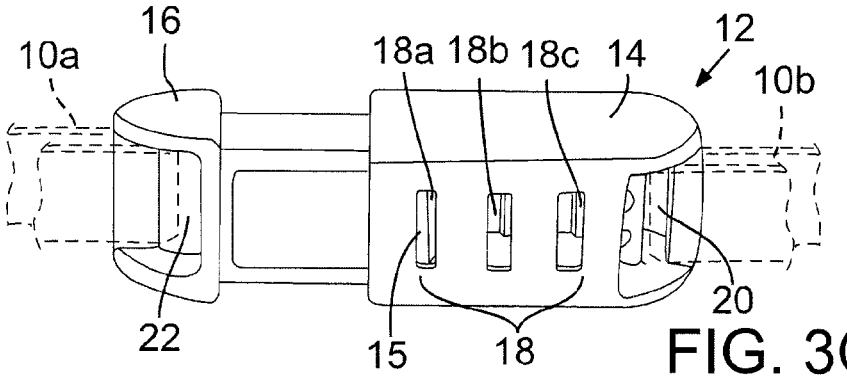
FIG. 3C is an enlarged view of the detaching structure of FIG. 3A showing a third possible engagement position offering a third possible release resistance.
Figure 3D:
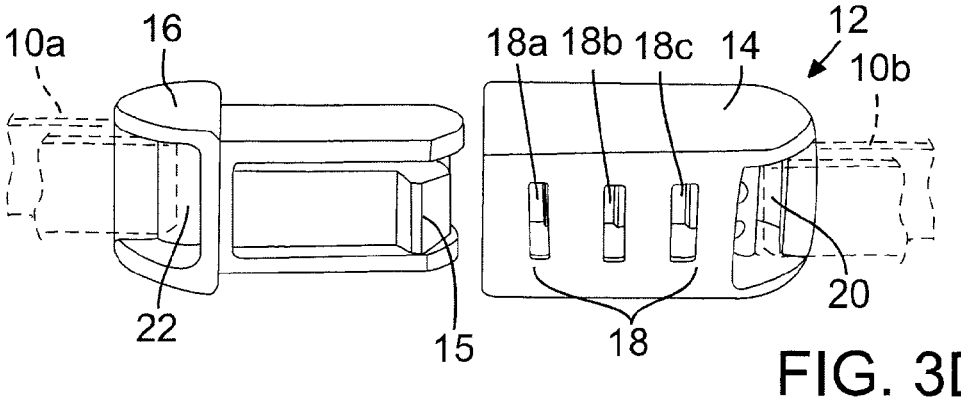
FIG. 3D is and enlarge view of the detaching structure of FIG. 3A showing a possible disengaged position

Preferably, at least three different release settings are engineered into the detaching structure so an athlete can first set it on the $3^{rd}$ clip position (pushed all the way in as shown in FIG. 3A) for the highest resistance. At this resistance level, the force required to "break" the female portion free from the two tab positions is preferably about 25 pounds. Athletes first using the training belt system 10 should start on this setting. As they progress, they can clip the detaching structure on the middle setting (medium resistance shown in FIG. 3B) or on the first setting (lightest resistance shown in FIG. 3C).

Alternatively, a plurality of spaced apart protrusions 15 may be positioned on each side of the male portion 16 and aligned so as to allow the user to select the number of protrusions 15 that will engage the openings 18*a-c*. For example, with three pairs of spaced apart protrusions 15 on the sides of the male portion 16, the user can position the male portion 16 so that each pair of protrusions operably engages one of the pair of openings 18*a-c*. This configuration provides the maximum amount of protrusions engaging the maximum amount of openings 18*a-c*, thereby providing the highest degree of release resistance.

To reduce the amount of release resistance, the user slides the male portion away from the female portion, so that fewer protrusions engage openings 18*a-c*. It can be appreciated that the least amount of release resistance can be achieved simply by continuing to slide the male portion away from the female portion so that only one pair of protrusions 15 operably engage one pair of openings 18*a*.

The detaching structure as previously described provides consistent and reliable tension each time. Moreover, the defined release resistance for each configuration will not degrade over time like with hook and loop material and the like. The detaching structure can also be used for additional resistance training if scaled up or used in its present form for additional reaction training drills.

Having described and illustrated the principles of our invention with reference to a preferred embodiment thereof, it will be apparent that the invention can be modified in arrangement and detail without departing from such principles. Accordingly, in view of the many possible embodiments to which the principles may be put, it should be recognized that the detailed embodiments are illustrative only and should not be taken as limiting the scope of our invention. Accordingly, we claim as our invention all such modifications as may come within the scope and spirit of the following claims and equivalents thereto.

We claim:

1. A reaction training belt system comprising:

a first belt and a second belt, wherein each of the first and the second belts comprises an adjustment structure configured to adjustably secure said belt around a waist of a human wearer;

a detaching structure configured to detachably secure said first belt to said second belt, said detaching structure including a male portion securable to one of the first belt or the second belt and a female portion securable to the other belt;

said male portion comprising a first surface having a first protrusion separated from a second protrusion by a first distance and said female portion comprising a first surface having a first recess separated from a second recess by the first distance;

wherein said male portion is releasably securable in a first position relative to said female portion to provide a first release resistance, in which the first protrusion is releasably engaged in the first recess; and wherein said male portion is further releasably securable in a second position relative to said female portion to provide a second release resistance, in which the first protrusion is releasably engaged in the second recess and upon the engagement of the first protrusion at the second position, the second protrusion is releasably engaged with the first recess.

2. The reaction training belt system of claim 1, further comprising a second adjustment structure configured to adjust the length of the first or second belt when adjustably secured around a waist of a human wearer.

3. The reaction training belt system of claim 1, wherein at least a portion of said male portion is slideably receivable within said female portion.

4. The reaction training belt system of claim 1, wherein the first recess is sized differently than the second recess whereby a different degree of release resistance is created.

5. The reaction training belt system of claim 1, wherein the female portion further comprises a third recess separated from the second recess by the first distance.

6. The reaction training belt system of claim 5, wherein the male portion further comprises a third protrusion separated from the second protrusion by the first distance.

7. The reaction training belt system of claim 6, wherein said male portion is further releasably securable in a third position relative to said female portion to provide a third release resistance, in which the first protrusion is releasably engaged in the third recess and upon the engagement of the first protrusion at the third position, the second protrusion is releasably engaged with the second recess and the third protrusion is releasably engaged with the first recess.

8. The reaction training belt system of claim 1, wherein the male portion comprises a third protrusion and the female portion comprises a third recess.

9. A reaction training belt system comprising:

a first belt and a second belt, wherein one of the first or the second belt comprises a first adjustment structure configured to adjust the length of the respective belt when adjustably secured around a waist of a first wearer;

a detaching structure configured to detachably secure said first belt to said second belt, said detaching structure includes a male portion securable to said first belt and a female portion securable to a second belt; and wherein said male portion includes a first pair of opposing protrusions extending therefrom and said female portion includes a plurality of paired opposing recesses each adapted to releasably engage the first pair of opposing protrusions of the male portion, each pair of recesses having a different size whereby a different degree of release resistance is created depending on the pair of said recesses in which said first pair of protrusions is positioned.

10. The reaction training belt of claim 9, wherein said male portion is operably securable to a first position relative to said female portion to provide a first release resistance, and said male portion is operably securable to a second position relative to said female portion to provide a second release resistance.

11. The reaction training belt system of claim 9, further comprising a second adjustment structure configured to adjust the length of the first or second belt when adjustably secured around a waist of a first wearer.

12. The reaction training belt system of claim 9, wherein at least a portion of said male portion is slideably receivable within said female portion.

13. The reaction training belt system of claim 9, wherein said detaching structure includes an additional means for adjusting the release resistance between said first belt and said second belt.

14. A reaction training belt system comprising:

a first belt and a second belt, wherein each of the first and the second belt comprises an adjustment structure configured to adjustably secure said belt around a waist of a human wearer;

a detaching structure configured to detachably secure said first belt to said second belt, said detaching structure including a male portion securable to said first belt and a female portion securable to said second belt;

said male portion comprising a first pair of opposing protrusions separated from a second pair of opposing protrusions by a first distance and said female portion comprising a first pair of opposing recesses separated from a second pair of opposing recesses by the first distance;

wherein said male portion is releasably securable in a first position relative to said female portion to provide a first release resistance, in which the first pair of opposing protrusions are releasably engaged in the first pair of opposing recesses; and wherein said male portion is further releasably securable in a second position relative to said female portion to provide a second release resistance, in which the first pair of opposing protrusions are releasably engaged in the second pair of opposing recesses and upon the engagement of the first pair of opposing protrusions at the second position, the second pair of opposing protrusions are releasably engaged with the first pair of opposing recesses.

15. The reaction training belt system of claim 14, further comprising a second adjustment structure configured to adjust the length of the first or second belt when adjustably secured around a waist of a human wearer.

16. The reaction training belt system of claim 14, wherein at least a portion of said male portion is slideably receivable within said female portion.

17. The reaction training belt system of claim 14, wherein said detaching structure including means for adjusting the release resistance between said first belt and said second belt.

18. The reaction training belt system of claim 16, wherein the female portion further comprises a third pair of opposing recesses separated from the second pair of opposing recesses by the first distance.

19. The reaction training belt system of claim 18, wherein the male portion further comprises a third pair of opposing protrusions separated from the second pair of opposing protrusions by the first distance.

20. The reaction training belt system of claim 19, wherein said male portion is further releasably securable in a third position relative to said female portion, to provide a third release resistance, in which the first pair of opposing protrusions are releasably engaged with the third pair of opposing recesses, the second pair of opposing protrusions are releasably engaged with the second pair of opposing recess and the third pair of opposing protrusions are releasably engaged with the first pair of opposing recesses.

* * * * *